United States Patent [19]

Nakamura

[11] Patent Number: 4,518,161

[45] Date of Patent: May 21, 1985

[54] SHEET SORTING APPARATUS

[75] Inventor: Kunihiko Nakamura, Yokohama, Japan

[73] Assignee: Tokyo Shibaura Denki Kabushiki Kaisha, Kawasaki, Japan

[21] Appl. No.: 452,925

[22] Filed: Dec. 27, 1982

[30] Foreign Application Priority Data

Jan. 22, 1982 [JP] Japan ..... 57-7519
Apr. 8, 1982 [JP] Japan ..... 57-57245

[51] Int. Cl.[3] ..... B65H 29/60

[52] U.S. Cl. ..... 271/303; 198/367; 271/901

[58] Field of Search ..... 271/303, 305, 297, DIG. 3, 271/198; 198/367, 442

[56] References Cited

U.S. PATENT DOCUMENTS

| | | | |
|---|---|---|---|
| 3,565,423 | 2/1971 | Kluth | 271/303 |
| 3,667,753 | 6/1972 | Norton | 271/303 |
| 3,776,546 | 12/1973 | Erickson et al. | 271/303 |
| 3,889,811 | 6/1975 | Yoshimura | 209/74 M |
| 4,120,491 | 10/1978 | Lang | 271/303 |
| 4,195,724 | 4/1980 | Janitsch | 198/626 |
| 4,251,000 | 2/1981 | Templeton | 271/303 |
| 4,277,061 | 7/1981 | Nagel et al. | 271/DIG. 3 |
| 4,319,745 | 3/1982 | Pinard | 271/305 |

FOREIGN PATENT DOCUMENTS 0018991 3/1967 Australia .

OTHER PUBLICATIONS

Modern Dictionary of Electronics (Howard W. Sams & Co., Inc., 1968).

*Primary Examiner*—Bruce H. Stoner, Jr.
*Assistant Examiner*—John A. Carroll
*Attorney, Agent, or Firm*—Oblon, Fisher, Spivak, McClelland & Maier

[57] ABSTRACT

In a sheet sorting apparatus of this invention, two main belts for conveying sheets run one upon another through a predetermined section, and are then separated from each other so that a triangular space is defined between them. The shape of the space is determined by two separating pulleys and two guide pulleys. A separator member rockable in the space has a projected portion projecting between the separating pulleys. When the separator member is rotated, the projected portion engages one of the separating pulleys in the rotating direction to restrain the rotation of the separator member so that the sheets are guided into one of collectors corresponding to the rotating direction.

13 Claims, 12 Drawing Figures

SHEET SORTING APPARATUS

BACKGROUND OF THE INVENTION

This invention relates to a sheet sorting apparatus which comprises a delivery device for delivering sheets one after another, first and second main belts separated at an angle from each other after running through a main superposed section in which the belts hold and carry the delivered sheets, and defining a triangular space therebetween adjoining the main superposed section, first and second auxiliary belts superposed on part of the main belts to form first and second auxiliary superposed sections, respectively, pulley means for guiding all the belts, the pulley means including shape determining pulleys to determine the shape of the space, a separator member rockably supported in the space, the separator member rocking through a predetermined angle to guide the sheets fed from the main superposed section into the space to one of the auxiliary superposed sections corresponding to the rocking direction of the separator member, means for rocking the separator member, and first and second collectors receiving and holding therein the sheets delivered from the first and second auxiliary superposed sections.

The sheets include, for example, data cards, bank notes, etc., which are normally kept in piles. In order to classify or sort these piled sheets according to the kind of information or for regular division, it is necessary that the sheets be picked up one by one and delivered to a conveyor path, subjected to information reading or counting in the middle of the path, and then collected again in piles through diverging courses for each individual kind of information or for each regular lot.

Conventional sheet conveying systems include a belt conveyor system in which the sheets picked up one by one are carried to a predetermined position while they are held between a pair of belts running in contact with each other. Conventional means for shifting the course of the sheets transferred in the belt conveyor system most frequently has the following construction. The conveyor belts are separated in the middle of the conveyor path to define a fan-shaped spread between them. Two pulleys are provided inside the fan-shaped spread between the conveyor belts, and additional belts forming first and second independent paths individually in contact with the spreading conveyor belts are separately arranged on the two pulleys. A separator member which rotates in either direction around an axis parallel to the shafts of the pulleys is disposed in a substantially triangular space defined by the spreading portions of the conveyor belts and the two pulleys. The separator member has triangular lateral faces, and is rotated in the forward or reverse direction in response to a shifting command signal to form a gap between one side of the separator member and the spreading portion of one of the conveyor belts so that the sheets are carried through the gap. Then, the sheets are delivered to the first or second path formed by the belt on one of the pulleys located behind the separator member and the spreading portion of one of the conveyor belts, and are held and carried to the predetermined position.

Conventionally, a rotary solenoid or a reversible motor is used as a driving source for rotating the separator member The rotary solenoid has a function to convert linear motion mechanically to a rotary stroke by the use of a plunger-type solenoid. When using the rotary solenoid, the rotation may be reversed compulsorily by means of a spring or by using a pair of rotary solenoids with the same function with are connected coaxially in opposite direction. In the latter case, one of the solenoids is excited for forward or reverse rotation. When using the reversible motor, the rotary stroke of the separator member is usually fixed by means of an external stopper against which an arm attached to the rotating shaft of the separator member is to abut.

In the prior art sheet sorting apparatus of the aforementioned construction, the means for fixing the rotary stroke of the separator member involves the following drawbacks.

(1) The number of parts used in the apparatus is increased to result in complicated construction and higher cost. Namely, the driving source using the rotary solenoid requires a spring or an additional rotary solenoid for the reversal of rotation, while the one using the reversible motor requires an arm and a stopper for the positioning of the separator member.

(2) The separator member cannot provide adequate high speed response for the reversal of rotation. In the driving source using the spring for the reversal as mentioned in item (1), the spring force acts in one direction only, so that the forward rotation of the separator member requires a great enough force to surpass the spring force, resulting in a reduction of high speed response. In the driving source using the coupled pair of rotary solenoids, the rotating part is longer (about twice) and heavier, so that the moment of inertia is increased. In the case where the reversible motor is used, the arm on the shaft for positioning adds to the weight of the apparatus to increase the moment of inertia. Thus, quick rotation of the separator member is prevented.

(3) In all those shaft driving systems, the force applied to the shaft or the increased weight leads to an increase in the required power source capacity. In the spring-type driving source, in particular, the position of the solenoid cannot be maintained unless the solenoid continues to be supplied with enough electric power to counter the spring force. Accordingly, the solenoid may be heated, and the rotating shaft takes a long time to stop its vibration at the end of the operation. Thus, the separator member cannot be positioned in a short time.

(4) In the driving system using the reversible motor, the separator member is positioned by striking the arm attached to the rotating shaft against the stopper. The higher the operating speed, therefore, the greater the force on the arm at the moment of impact will be. Accordingly, high-speed operation may damage the stopper or arm. Accordingly the stopper and the arm mut be made with a special strong material. Moreover, the vibration caused at the impact will continue for a short time, and the separator member cannot be positioned accurately. As a result, the passage defined by one lateral face of the separator member and the conveyor belt lacks stability, so that the sheets led into the passage will possible run against the vibrating separator member to jam.

SUMMARY OF THE INVENTION

The object of this invention is to provide a sheet sorting apparatus free from the aforementioned drawbacks of the prior art apparatus and capable of quickly shifting the course of sheets being conveyed by means of belts.

In order to attain the above object, a sheet shorting apparatus of this invention is so constructed that a separator member for shifting the course of sheets is rocked through a predetermined angle when at least one projected portion of the separator member is caused to engage space-shape determining pulley means.

In a preferred embodiment of this invention, the driving source for rocking the separator member is a rotary magnet including a stator having two salient poles wound with coils and made of soft magnetic material and a rotor formed of a parmanent magnet.

In the sheet sorting apparatus of the invention having the aforementioned construction, the separator member is caused to directly engage the space-shape determining pulley means to be retained in a predetermined angular position, so that it is unnecessary to provide the rotating part with an arm to engage an external stopper. Accordingly, the rotating part is simplified in construction, and is lowered in the moment of inertia. With use of the rotary magnet, the separator member can be rotated in either direction by changing the direction of current to be passed through the projected poles of the stator. Once the separator member is rocked in one direction to engage the space-shape determining pulley means, it will continue to be interlocked with the pulley means while pressing thereon, as described in detail later, even if the current is cut off from the coils. Except when the separator member needs to be shifted, therefore, the current to flow through the coils may be reduced to zero or minimized for the economy of electric power. The use of the rotary magnet of the aforementioned construction obviates the necessity of a spring to urge the separator member and of paired rotary solenoids to operate in opposite directions. Thus, the rotating part including the rotary magnet and the separator has a lower moment of inertia, and the torque on the rotary magnet is relatively small. Accordingly, when current is passed through the coils of the rotary magnet, the separator member quickly rocks through a given angle in the direction corresponding to the current flow and stops. If the current is cut off thereafter, the separator member will never move from the stop position.

DETAILED DESCRIPTION OF THE PREFERRED EMBODIMENTS

Figure 1:
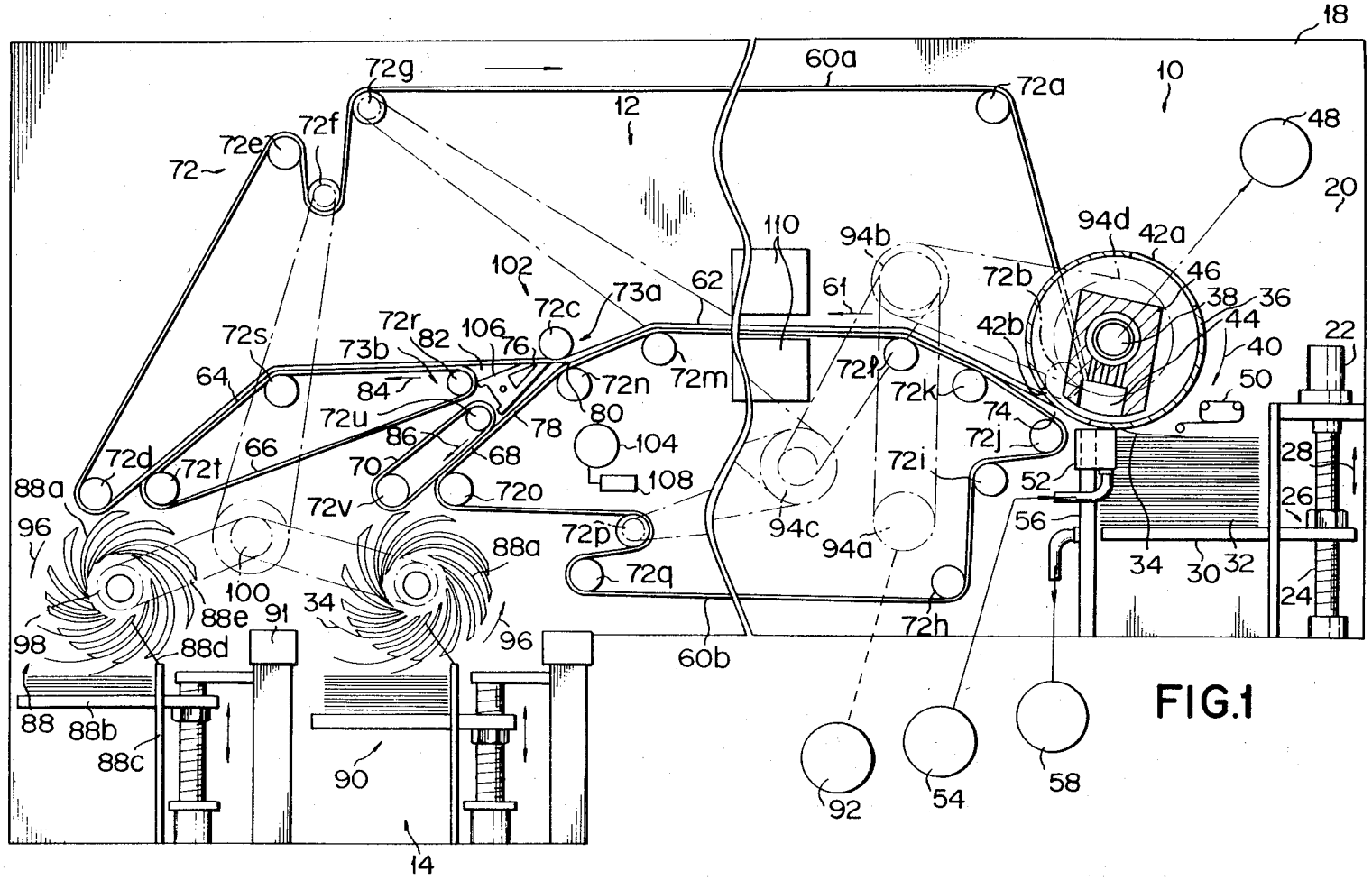
FIG. 1 is a front view of a sheet sorting apparatus according to one embodiment of this invention.

FIG. 1 is a general view schematically showing a sheet processing apparatus with a sheet sorting apparatus according to an embodiment of this invention. The sheet sorting apparatus comprises a delivery device 10 for delivering sheets one by one out of a pile of sheets, a transfer device 12 for transferring the sheets delivered from the delivery device 10, and a collecting device 14 which receives one by one the sheets transferred by the transfer device 12 to collect the sheets in a pile therein, and then carries out the sheets.

The delivery device 10 comprises a sheet table 30 moved up and down, as indicated by an arrow 28, by an elevator mechanism 26 including a motor 22 and a ball screw 24 attached to a vertical wall 20 of a mounting frame 18, and a rotating drum 36 which attracts and carries to the left of FIG. 1 the uppermost sheet 34 out of a pile of sheets 32 on the sheet table 30. The rotating drum 36, whose axial length is shorter than the width of the sheet 34, is rotated in the direction indicated by an arrow 40, supported by a shaft 38 extending at right angles to the drawing plane of FIG. 1. Suction holes 42*a* and 42*b* are bored through two opposite portions of the peripheral wall of the rotating drum 36. A suction nozzle 46 is fixed inside the rotating drum 36, having its inlet port 44 opposed to the inner surface of the peripheral wall of the drum 36. The suction nozzle 46 is connected to a suction pump 48. Thus, in the delivery device 10, the uppermost sheet 34 is attracted to the peripheral surface of the rotating drum 36 every time either suction hole 42*a* or 42*b* passes in front of the inlet port 44 of the suction nozzle 46, and is moved to the left as the rotating drum 36 rotates. In FIG. 1, numeral 50 designates a limit switch which gives a control signal for substantially fixing the height of the uppermost sheet 34 of the sheet pile 32. Numeral 52 designates a blast nozzle for blowing air from a compressor 54 against the delivery-side end face of the sheet pile 32 so that the sheets are separated from one another. Numeral 56 denotes a suction duct connected to a suction pump 58 to prevent two or more superposed sheets from being attracted to the rotating drum 36 at a time.

The sheets 34 delivered from the delivery device 10 are fed into the transfer device 12. The transfer device 12 comprises two first main belts 60*a* extending parallel to the left side of FIG. 1 from both end portions of the rotating drum 36 at a substantially fixed space, second main belts 60*b* located individually under the main belts 60*a* and circumscribed with the main belts 60*a* to form a main superposed section 62 which receives the sheets 34 from the delivery device 10 and carries them in the direction of an arrow 61, first auxiliary belts 66 circumscribed with the first main belts 60*a* to form a first auxiliary superposed section 64 capable of conveying the sheets, second auxiliary belts 70 circumscribed with the second main belts 60*b* to form a second auxiliary superposed section 68 capable of conveying the sheets, and a number of pulleys for guiding the belts 60*a*, 60*b*, 66 and 70. The transfer device 12 further comprises means for distributing the sheets delivered from the main superposed section 62 to the first or second auxiliary superposed section 64 or 68, and means for circulating the belts in loops. The belts 60*a*, 60*b*, 66 and 70 are provided in pairs so that they may hold the sheets 34 on both sides. FIG. 1 shows only one of each pair because of the level angle of view. The pulleys are attached to supporting shafts protruding from the vertical wall 20 at right angles to the drawing plane of FIG. 1, and guide the parallel pairs of belts 60*a*, 60*b*, 66 and 70. The respective hidden counterparts of the illustrated belts run through paths parallel to those of the illustrated ones and in the same manner. In the description to follow, therefore, only the belts and pulleys shown in FIG. 1 will be mentioned.

As mentioned before, the pulleys 72*a*, 72*b*, . . . , 72*u* and 72*v* are attached to the vertical wall 20 of the frame 18. The first main belt 60*a* passes the pulley 72*a* to reach the pulley 72*b*, turns its course near its corresponding end face of the rotating drum 36 to run in the direction of the arrow 61, and then returns to the pulley 72*a* via the pulleys 72*l*, 72*m*, 72*c*, 72*s*, 72*d*, 72*e*, 72*f* and 72*g*. The second main belt 60*b* successively passes the pulleys 72*h* and 72*i* to reach the position off to the lower left of the rotating drum 36, turns its course at the pulley 72*j*, and then returns to the pulley 72*h* via the pulleys 72*k*, 72*l*, 72*m*, 72*n*, 72*o*, 72*p* and 72*p*. As shown in FIG. 1, those portions of the first and second main belts 60*a* and 60*b* which pass the pulleys 72*b* and 72*j* are separated from each other. The two main belts 60*a* and 60*b* meet at the pulley 72*k*, and are in contact at the main superposed section 62 which extends from the pulley 72*k* to the two facing pulleys 72*c* and 72*n*. Defined between that portion of the first main belt 60*a* which extends between the pulleys 72*b* and 72*k* and that portion of the second main belt 60*b* which extends between the pulleys 72*j* and 72*k* is a substantially V-shaped swallowing inlet 74 which spreads from the pulley 72*k* toward the pulleys 72*b* and 72*j*. After passing through the main superposed section 62, the first main belt 60*a* runs in the course determined by the pulleys 72*c* and 72*r*, while the second main belt 60*b* runs in the course determined by the puleys 72*n* and 72*u* and at an angle to the course of the first main belt 60*a*. The running section of the first main belt 60*a* between the pulleys 72*c* and 72*r* is defined as a first slanting section 76, while the running section of the second main belt 60*b* between the pulleys 72n and 72*u* is defined as a second slanting section 78. The terminal point of the main superposed section 62 at which the first and second main belts 60*a* and 60*b* are separated is defined as a main belt diverging point 80. As shown in FIG. 1, a substantially triangular space 82 with the main belt diverging point 80 as one of its vertexes is defined between the first and second slanting sections 76 and 78. The pulleys 72*c* and 72*n*, which determine the diverging point of the main belts 60*a* and 60*b*, may be called separating pulleys 73*a*. The pulleys 72*r* and 72*u*, which determined the courses of the first and second slanting sections 76 and 78, may be called guide pulleys 73*b*.

The first auxiliary belt 66 circulates around the pulleys 72*r*, 72*s* and 72*t*, circumscribed with the first main belt 60*a* which runs toward the pulley 72*d* via the pulleys 72*r*, 72*s* and 72*t* after passing through the first slanting section 76. Thus, the first main and auxiliary belts 60*a* and 66 running from the pulley 72*r* to the pulley 72*t* define the first auxiliary superposed section 64 to hold and convey the sheets 34. The second auxiliary belt 70 circulates around the pulleys 72*u* and 72*v*, circumscribed with the second main belt 60*b* which runs toward the pulley 72*o* after passing through the second slanting section 78. The second main and auxiliary belts 60*b* and 70 meet between the pulleys 72*u* and 72*o* to define the second auxiliary superposed section 68 to hold and convey the sheets 34. Arrows 84 and 86 indicate the courses or running directions of the first and second auxiliary belts 66 and 70, respectively. The sheets 34 delivered from the main superposed section 62 are sorted in the space 82 and guided by the first or second auxiliary superposed section 64 or 68 in the manner to be mentioned later. If distributed to the section 64, the sheets 34 are discharged from between the pulleys 72*d* and 72*t* to be supplied to a first collector 88. If distributed to the section 68, the sheets 34 are discharged from between the pulleys 72*v* and 72*o* to be supplied to a second collector 90.

Pulleys 94*a*, 94*b* and 94*c* which are driven by a motor 92 are attached to the back of the vertical wall 20 of the frame 18 to run the belts 60*a*, 60*b*, 66 and 70 shown in FIG. 1. The first main belt 60*a* is driven by a belt stretched between the pulleys 94*c* and 72*g*, while the second main belt 60*b* is driven by a belt stretched between the pulleys 94*c* and 72*p*. The rotating drum 36 is rotated by a belt coupling the pulley 94*b* and a pulley 94*d* which is mounted on the shaft 38 of the rotating drum 36. The first and second auxiliary belts 66 and 70 may be driven by frictional force between themselves and the first and second main belts 60*a* and 60*b*. In case of a shortage of torque, however, it is only necessary that, for example, the pulley 94*c* be coupled by belts with representative pulleys to guide the auxiliary belts 66 and 70, individually.

The collecting device 14 comprises the first and second collectors 88 and 90. Since the two collectors 88 and 90 have the same construction and function in the same manner, only the first collector 88 will be described in detail. The first collector 88 includes two laminar collecting wheels 88*a* which are located right under the pulleys 72*d* and 72*t* so as to receive the sheets 34 discharged from between the pulleys 72*d* and 72*t* and rotate about a shaft extending at substantially right angles to the drawing plane of FIG. 1, a collecting table 88*b* disposed under the collecting wheels 88*a* and capable of being moved up and down by a motor 91, a side wall 88*c* on the right of the collecting table 88*b*, and a stop plate 88*d* extending close to the shaft between the two collecting wheels 88*a*. The collecting wheels 88*a* are arranged at a space narrower than the width of the sheet 34 at substantially right angles to the drawing plane of FIG. 1. Each collecting wheel 88*a* is provided with a plurality of curved slots 88*e* each in the form of an involute curve opposed to the rotating direction (arrow 96). The collecting wheels 88*a* are driven by a pulley 98 attached thereto, a pulley 100 attached to the vertical wall 20 of the frame 18, the pulley 72*f*, and belts stretched between these pulleys as shown in FIG. 1. With such belt connection, the curved slots 88*e* rotate a pitch as the rotating drum 36 makes a half turn. Thus, the sheets 34 discharged through the first auxiliary superposed section 64 are received successively by their adjoining curved slots 88*e*, and rotate together with the collecting wheels 88*a* as they are substantially swallowed up by the curved slots 88*e*. When the collecting wheels 88*a* rotate to cause the forward edges of the sheets 34 to abut against the stop plate 88*d*, the sheets 34 stop on the spot, although the collecting wheels 88*a* keep on rotating. Accordingly, the sheets 34 are forced out from their corresponding curved slots 88*e*, and are piled up on the collecting table 88*b*.

Figure 4:
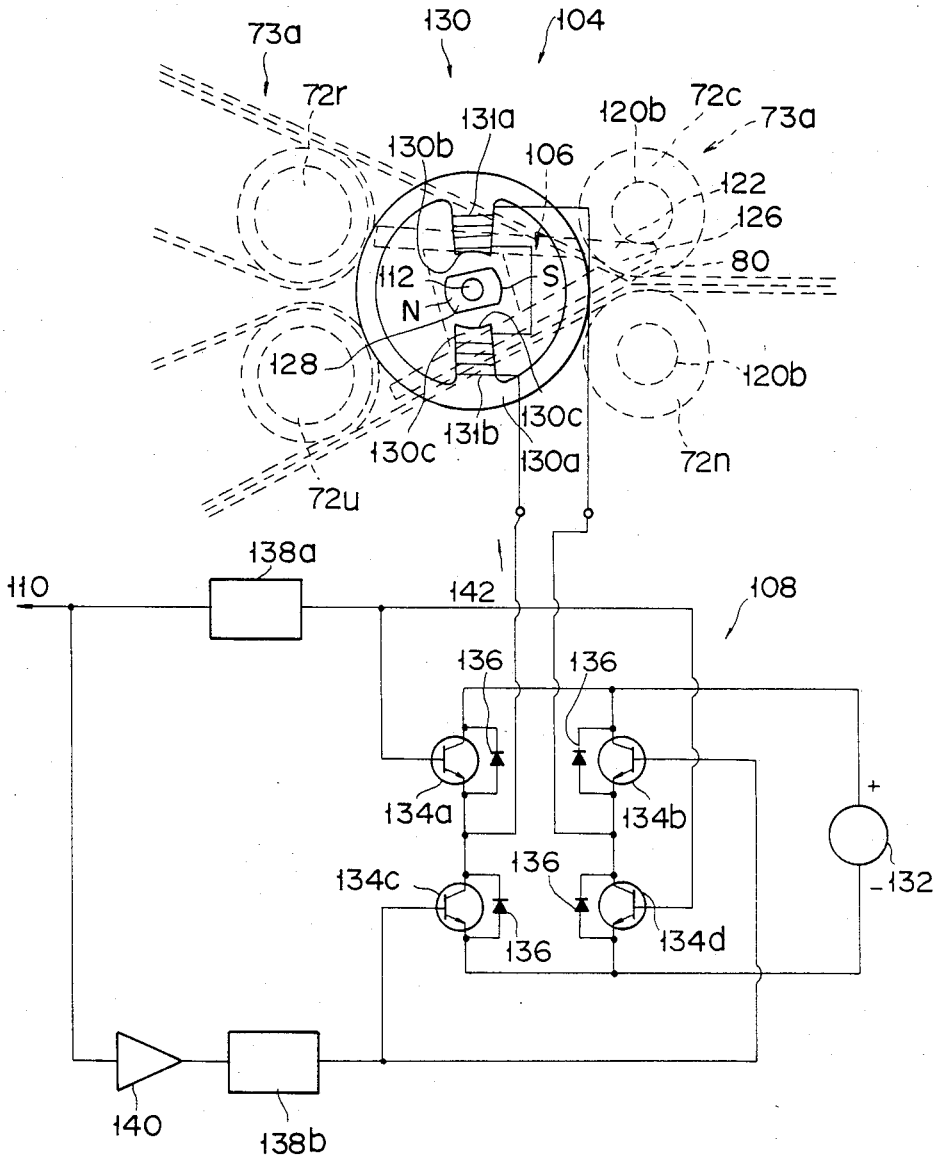
FIG. 4 is a diagram for illustrating the construction of a rotary magnet shown in FIG. 1 and a driving circuit therefor.

There will now be described a sorting mechanism 102 which sorts the sheets 34 delivered from the main superposed section 62 to distribute them to the first or second collector 88 or 90. As shown in FIG. 4, the sorting mechanism 102 comprises a separator member 106 rotated by a rotary magnet 104, a driving circuit 108 for rotating the rotary magnet 104, and a control unit 110 to deliver command signals to the circuit 108.

Figure 2:
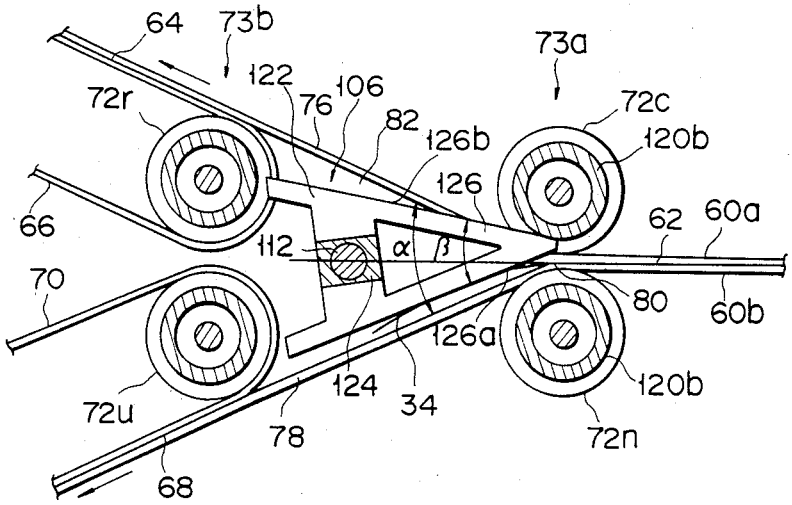
FIG. 2 is a front view of a sorting mechanism of the apparatus of FIG. 1 showing one operating state thereof.

FIG. 2 shows the way the main belts 60*a* and 60*b* are separated at the diverging point 80 and run through the first and second slanting sections 76 and 78 while defining the triangular space 82 between them. The shape of the space 82 is determined by the separating pulleys 73*a* and the guide pulleys 73*b*. Therefore, the separating and guide pulleys 73*a* and 73*b* are referred to generally as space-shape determining pulleys. The angle formed between the first and second slanting sections 76 and 78 is referred to as a space angle $\alpha$. Disposed substantially in the center of the space 82 is the separator member 106 rockable around a rotating shaft 112 which is substantially parallel to the shafts of the four pulleys 72*c*, 72*n*, 72*r* and 72*u*.

Figure 3:
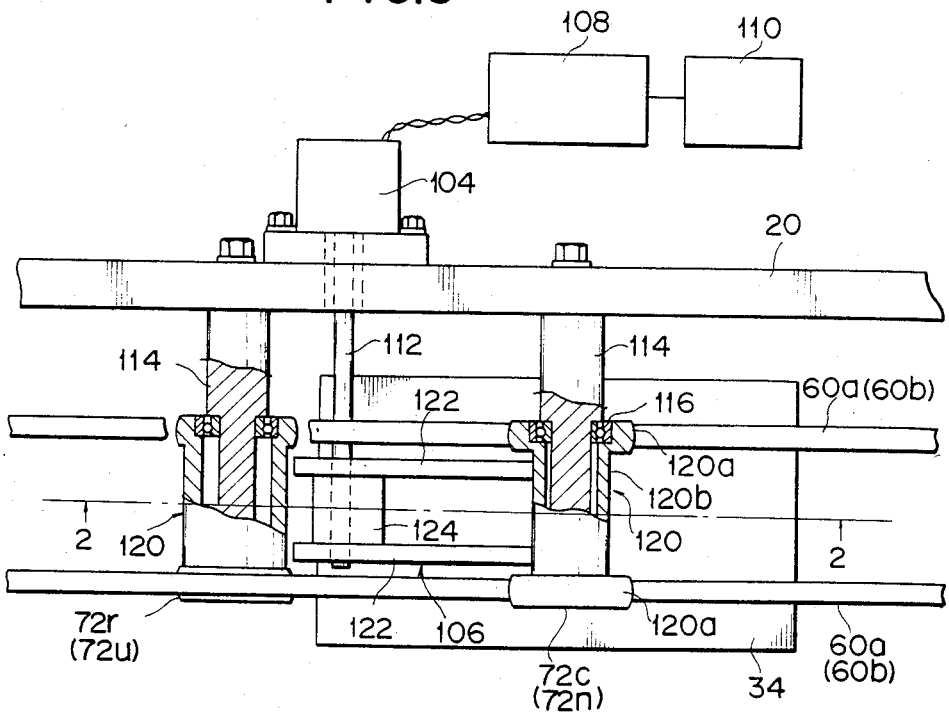
FIG. 3 is a plan view of the sorting mechanism of FIG. 2.

FIG. 3 is a top view showing the members shown in FIG. 2 and other related members. The pulleys 72*c* and 72*r* of the same shape protrude from the vertical wall 20. The pulley 72*c* has a supporting shaft 114 mounted on the vertical wall 20 at right angles, two ball bearings 116 embedded in the stepped portion and the extreme end of the supporting shaft 114, and a rotating portion 120 consisting of large-diameter portions 120*a* attached individually to the outer peripheries of the ball bearings 116 to guide the two first main belts 60*a* spaced and put thereon, and a small-diameter neck portion 120*b* coupling the two large-diameter portions 102*a*.

The pulley 72*n* (unseen in FIG. 3) of the same configuration is mounted on the vertical wall 20 under the pulley 72*c* of FIG. 3, and the pulleys 72*r* and 72*u* (not shown) sharing the configuration with the pulley 72*c* are mounted on the vertical wall 20 in vertical alignment.

As shown in FIG. 3, a rotary magnet 104 is attached to the vertical wall 20, and the rotating shaft 112 of its rotor 128 (FIG. 4) penetrates the vertical wall 20 to project into the substantially central portion (FIG. 4) of the space 82. The separator member 106 made of a light material, such as synthetic resin, is attached to the projected end of the shaft 112. As seen from FIG. 3, the separator member 106 is formed of two laminar shifting blocks 122 of the same shape arranged at a space narrower than the space between the main belts 60*a* (or 60*b*), and a coupling portion 124 connecting the shifting blocks 122. As shown in FIG. 2, each shifting block 122 is in the form of an isosceles triangle with its vertical angle or separator angle $\beta$ narrower than the space angle $\alpha$, and is attached to the rotating shaft 112 of the rotary magnet 104 substantially on the bisector of the vertical angle $\beta$. A triangular projected portion 126 of the shifting block 122 including the vertical angle $\beta$ projects between the respective neck portions 120*b* of the pulleys 72*c* and 72*n*. Thus, the shifting blocks 122 can rotate both clockwise and counterclockwise around the rotating shaft 112. The clockwise rotation of the shifting blocks 122 is allowed until respective lateral faces 126*a* of the shifting blocks 122 engage the neck portion 120*b* of the pulley 72*n*, while the counterclockwise rotation is allowed until lateral faces 126*b* engage the neck portion 120*b* of the pulley 72*c*. The separator angle $\beta$ is to set that, when the shifting blocks 122 are rotated to their motion limits in the counterclockwise direction, a substantially parallel path is defined between the lateral faces 126*a* and the second slanting sections 78 of the second main belts 60*b*, along which the sheets 34 delivered from the main suerposed section 62 are led to the second auxiliary superposed section 68, guided by the lateral faces 126*a*, and that, when the shifting blocks 122 reach their motion limits in the clockwise direction, the sheets 34 are led to the first auxiliary superposed section 64 through a path between the respective lateral faces 126*b* of the shifting blocks 122 and the first slanting sections 76 of the first main belts 60*a*, guided by the lateral faces 126*b*.

FIG. 4 is a diagram for illustrating the construction and operation of the rotary magnet 104. In FIG. 4, the members shown in FIG. 2 are drawn with broken lines, and the rotary magnet 104 is drawn with full lines. The rotary magnet 104 includes a rotor 128 formed of a permanent magnet having north and south poles and mounted on the rotating shaft 112, a stator 130 consisting of a circular yoke 130*a* made of a soft magnetic material and two projected poles 130*b* and 103*c* protruding from the yoke 130*a* toward the center thereof and diametrically facing each other, and coils 131*a* and 131*b* wound in the same direction around the projected poles 130*b* and 130*c*, respectively.

The driving circuit 108 of FIG. 4 is supplied with electric power from a DC power source 132, and operates when it receives a control signal delivered from the control unit 110. Thus, the driving circuit 108 supplies the coils 131*a* and 131*b* of the rotary magnet 104 with current flowing in a desired direction. The driving circuit 108 includes four transistors 134*a*, 134*b*, 134*c* and 134*d*. The collectors of the transistors 134*a* and 134*b* are connected to a positive power source, while the emitters of the transistors 134*c* and 134*d* are connected to a negative power source. The emitter of the transistor 134*a* and the collector of the transistor 134*c* are connected to each other and to one end of an exciting circuit formed of the coils 131*a* and 131*b*. The emitter of the transistor 134*b* and the collector of the transistor 134*d* are connected to each other and to the other end of the exciting circuit. A diode 136 is connected between the emitter and collector of each of the four transistors in the reverse direction to the voltage of the DC power source 132. The control signal from the control unit 110 is supplied to the bases of the transistors 134*a* and 134*d* through a gate circuit 138*a*, and is also supplied as a signal of opposite polarity to the bases of the transistors 134*b* and 134*c* through an inverter 140 and a gate circuit 138*b*. If the gate circuit 138*a* is supplied with a positive square-wave signal to deliver a positive pulse at the rise of the signal, a negative pulse is delivered from the gate circuit 138*b*. Then, the transistors 134*a* and 134*d* are turned on, while the transistors 134*b* and 134*c* are turned off. Thus, a current in the direction of an arrow 142 flows through the coils 131*a* and 131*b*. At the fall of the square-wave signal, a negative pules signal is delivered from the gate circuit 138*a*, and a positive pulse signal is delivered from the gate circuit 138*b*. At this time, therefore, only the transistors 134*b* and 134*c* are allowed to operate, so that a current in the direction opposite to the arrow 142 flows through the coils 131*a* and 131*b* of the rotary magnet 104. When the rotary magnet 104 is excited to rotate the rotor 128 from the angular position "0°" where it is brought to a standstill by attraction, the rotor 128 is subjected to a torque in a direction toward the angular position "0". The torque varies sinusoidally with the change of the angular position of the rotor 128. Namely, the torque is zero for the angular positions "0°" and "180°" and largest for the angular position "90°". If the current flowing through the coils 131*a* and 131*b* is inverted, the magnetic polarity of the projected poles 130*b* and 130*c* is inverted. Accordingly, the rotor 128 and hence the separator member 106 are subjected to clockwise or counterclockwise torque depending on the polarity, and engage the pulley 72*n* or 72*c* to cease from rotating.

There has been described the operation of the rotor 128 in the case where current is passed through the rotary magnet 104. For a better understanding of the advantages of the apparatus of this invention, however, it is necessary to appreciate the torque acting on the rotor 128 when the current is cut off from the coils 131*a* and 131*b*. In this case, the stator 130 serves only as a mere soft magnetic material. When allowed to rotate freely, the rotor 128 rotates and stops at the position where its north and south poles face the projected poles 130*b* and 130*c*, since the rotor 128 is formed of a permanent magnet. This position is one of two stable positions of the rotor 128. The other stable position is reached when the rotor 128 is rotated 180° from the one stable position. In these stable positions, the torque on the rotor 128 is zero. If the rotor 128 is rotated from one of the stable positions. The torque acting on the rotor 128 in the opposite direction to the rotating direction is gradually increased. The torque is largest when the rotor 128 is rotated 45°; zero for 90°, oppositely largest for 135°, and zero for 180°. The change of the torque is substantially sinusoidal with respect to the angular position of the rotor 128. Among those angular positions, the positions "0°" and "180°" are the stable positions of the rotor 128, as described before, and the position "90°" is the metastable position.

Accordingly, if the motor 128 is shifted from the metastable position toward the one stable position, the rotor 128 is subjected to such a torque that the rotor 128 is drawn to the one stable position. If the rotor 128 is shift toward the other or opposite stable position, the rotor 128 is subjected to such a torque that the rotor 128 is drawn to the opposite stable position.

Figure 5:
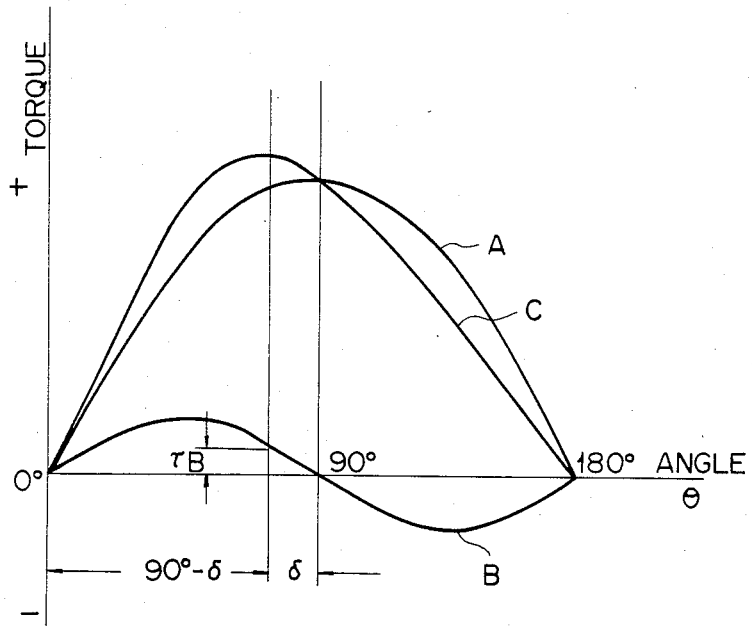
FIG. 5 is a graph for illustrating the change of torque produced by the rotary magnet of FIG. 4.

FIG. 5 is a graph showing the relationship between the rotation angle $\theta$ (axis of abscissa) of the rotor 128 and the torque $\tau$ (axis of ordinate) on the rotor 128 obtained when the rotor 128 is rotated e.g. clockwise from the first stable position ($\theta=0$) to the second stable position ($\theta=180°$) via the metastable position ($\theta=90°$). In this case, an exciting current is passed through the coils 131*a* and 131*b* of the rotary magnet 104, and the rotor 104 is subjected to clockwise torque when out of the two stable positions. In the graph of FIG. 5, positive and negative torques represent counterclockwise and clockwise torques of FIG. 4, respectively. Curve A represents the torque which is applied to the rotor 128 on the basis of the exciting current passed through the coils 131*a* and 131*b*, while curve B represents the torque which is produced between the rotor 128 and the projected poles 130*b* and 130*c* of the stator 130 on the basis of the magnetic moment of the rotor 128. These torques have already been described in detail. Curve C represents a composite torque obtained by combining the torques represented by curves A and B. This composite torque is actually applied to the rotor 128.

The rotary magnet 104 having the aforementioned torque characteristic is attached to the vertical wall 20 (FIG. 3) so that a straight line connecting the center of the rotating shaft 112 and the tip end of the projected portion 126 of each shifting block 122 substantially passes through the diverging point 80 of the main belts when the rotor 128 is in the metastable position as shown in FIG. 4. FIG. 4 shows the state in which the coils 131*a* and 131*b* are energized, and the shifting blocks 122 of the separator member 106 are subjected to counterclockwise torque to engage the pulley 72*c* at the neck portion 120*b*, thus standing still while pushing the neck portion 120*b* counterclockwise. The positions of the rotor 128, the separator member 106, and the shifting blocks 122 in this state are referred to as their respective counterclockwise rotation positions. At this time, the rotor 128 is subjected to a torque which corresponds to position "90°-$\delta$" where $\delta$ is the angle of rotation of the rotor 128 from the metastable position ($\theta=90°$ in FIG. 5) to the position of FIG. 4. When the rotor magnet 104 is deenergized in this state, the torque corresponding to curve A of FIG. 5 is reduced to zero, though the torque $\tau$B corresponding to curve B still remains, so that the rotor 128 keeps on receiving the counterclockwise torque. Thus, the sorting of the sheets will never be influenced by the cutting off of the exciting current.

By merely inverting the direction of the exciting current to flow through the coils 131*a* and 131*b*, the rotor 128 may be rotated clockwise to bring the shifting block 122 into contact with the neck portion 120*b* of the pulley 72*n*, thereby changing the way of sheet sorting. At this time, the rotor 128 rotates beyond the metastable position ($\theta=90°$), and the shifting block 122 engages the neck portion 120*b* of the pulley 72*n*. The positions of the rotor 128, the separator member 106, and the shifting blocks 122 in this state are referred to as their respective clockwise rotation positions. In this case, if current is cut off from the coil 131*a* and 131*b*, the rotor 128 keeps on receiving the clockwise torque, since it is rotated beyond the metastable position. Thus, the sheet sorting operation will never be confused by the interruption of the current.

Now the operation of the aforementioned embodiment will be described. When the sheet sorting apparatus of FIG. 1 is operated, the motor 22 of the elevator mechanism 26 rotates the ball screw 24 to raise the sheet table 30, thereby lifting up the sheet pile 32 on the table 30. The lifting operation is continued until the uppermost sheet 34 out of the sheet pile 32 reaches the fixed-level position to operate the limit switch 50. The uppermost sheet 34 is intermittently attracted by the inlet port 44 of the suction nozzle 46 housed in the rotating drum 36 every time the suction hole 40*a* or 40*b* of the rotating drum 36 faces the sheet 34, and is delivered toward the starting point of the main superposed section 62 formed by the overlapping portions of the first and second main belts 60*a* and 60*b*. When the forward edge of the sheet 34 just reaches the starting point of the main superposed section 62, the sheet 34 is released from the attraction by the rotating drum 36. Then, the sheet 34 is transferred through the medium of the friction between the first and second main belts 60*a* and 60*b*, and runs toward the terminal end of the main superposed section 62, held between the belts 60*a* and 60*b* at the main superposed section 62. Such operation is repeated intermittently, and the sheets 34 on the table 30 are picked up one after another, and conveyed through the main superposed section 62. Disposed near the main superposed section 62 is the control unit 110 which delivers a command signal to operate the sorting mechanism 102. The sorting mechanism 102 is intended to sort the sheets 34 to be delivered to the first collector 88 from those for the second collector 90. The control unit 110 may adopt various systems as follows. In one system, the command signal is applied to an input terminal 109 of the driving circuit 108 of FIG. 4 in accordance with the passage of operating time of the apparatus. In another system, the sheets 34 passing through the main superposed section 62 are counted so that the command signal is applied to the input terminal 109 when the number of the sheets 34 counted has reached a predetermined value. In still another system, an identification symbol previously assigned to each individual sheet 34 is sensed so that the command signal is applied to the input terminal 109 according to the symbol. The operation of the sorting mechanism 102 on the basis of an example of such system will be described later.

After passing by the control unit 110, the sheet 34 enters the triangular space 82 where its forward edge is unsupported. Pushed from the rear by the main superposed section 62, the sheet 34 goes deeper into the space 82. The course of the sheet 34 is determined when its forward edge abuts against the lateral faces 126*a* or 126*b* of the projected portions 126 of the shifting blocks 122 of the separator member 106. When the separator member 106 is rocked counterclockwise as shown in FIG. 2 in response to the command signal from the control unit 110, the sheets 34 run against the lateral faces 126*a* of the projected portions 126 of the shifting blocks 122 to be guided thereby, and are passed through the second auxiliary superposed section 68 and the collecting wheel 88*a* of the second collector 90 to be stacked on the collecting table 88*b*. When the separator member 106 is rocked clockwise in response to the command signal from the control unit 110, the sheets 34 run against the lateral faces 126*b* of the projected portions 126 of the shifting blocks 122 to be guided thereby, and are passed through the first auxiliary superposed section 64 and the collecting wheel 88*a* of the first collector 88 to be stacked on the collecting table 88*b*.

Figure 6:
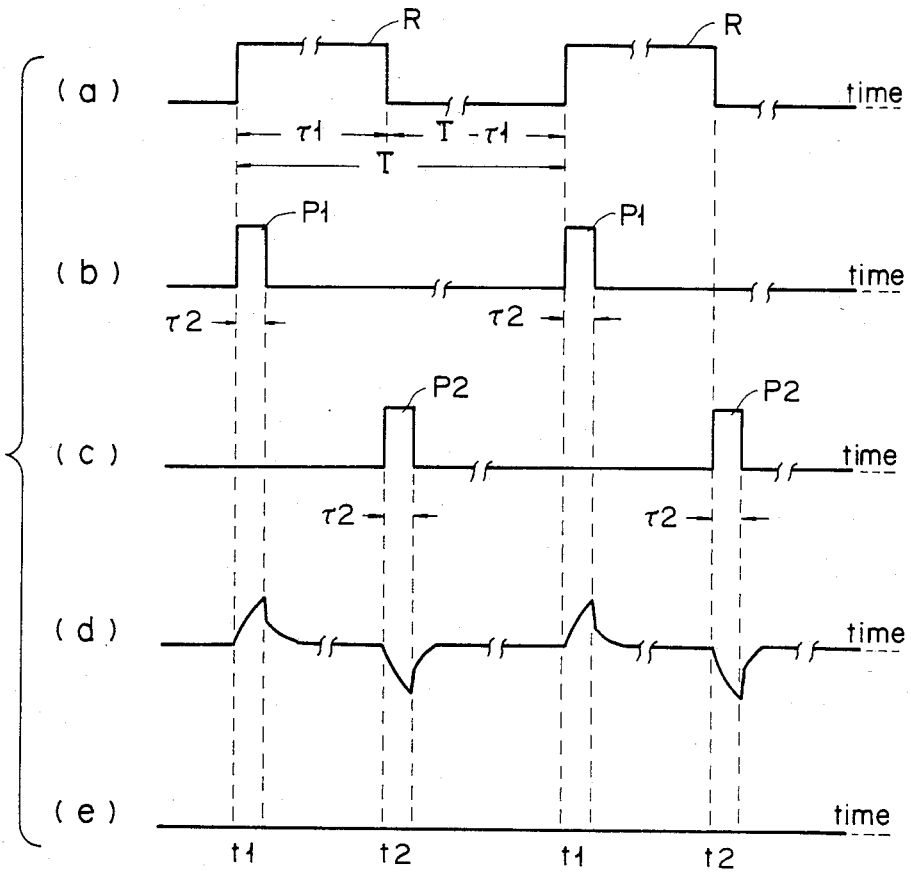
FIG. 6 is a chart for illustrating the operation of the rotary magnet.
Figure 7:
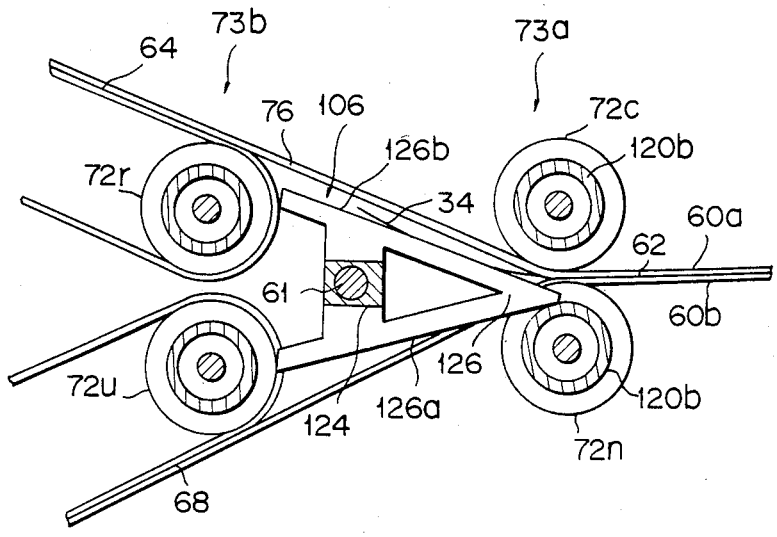
FIG. 7 is a front view of the sorting mechanism of FIG. 2 showing another operating state different from the state shown in FIG. 2.

FIG. 6 is a graph with its axes of abscissa and ordinate representing time and pulse height, respectively. In FIG. 6, curve (a) represents an example of the command signal delivered from the control unit 110. This signal is a square-wave command signal R with a pulse width $\tau_1$ repeated with a given period Y. This command signal is used to feed the sheets 34 into the second collector 90 during the time $\tau_1$ and into the first collector 88 during the remaining time Y-$\tau_1$. Curve (b) represents a pulse signal which is applied from the gate circuit 138*a* to the bases of the transistors 134*a* and 134*d* when the gate circuit 138*a* is supplied with the command signal R. Curve (c) represents a signal which is applied from the gate circuit 138*b* to the bases of the transistors 134*b* and 134*c* when the command signal R is supplied to the series circuit of the inverter 140 and the gate circuit 138*b*. As seen from curves (b) and (c), at time $t_1$ corresponding to the leading edge of the command signal R, a positive pulse signal $P_1$ with a pulse width $\tau_2$ is applied to the bases of the transistors 134*a* and 134*d*, while no signal is supplied to the transistors 134*b* and 134*c*. Accordingly, an exciting current in the direction of the arrow 142 is supplied from the driving circuit 108 of FIG. 4 to the rotary magnet 104. At time $t_2$ corresponding to the trailing edge of the command signal R, a positive pulse signal $P_2$ with the pulse width $\tau_2$ is applied to the bases of the transistors 134*b* and 134*c*, while no signal is applied to the bases of the transistors 134*a* and 134*d*. Accordingly, a current in the opposite direction to the arrow 142 is supplied from the driving circuit 108 to the rotary magnet 104. At time $t_1$, therefore, the separator member 106 coupled to the rotary magnet 104 can be rotated counterclockwise and stopped at the counterclockwise rotation position. At time $t_2$, on the other hand, the separator member 106 can be rotated clockwise and stopped at the clockwise rotation position. As seen from FIG. 6, the pulse signal $P_1$ and $P_2$ have a narrow pulse width, so that no exciting current is supplied to the rotary magnet 104 during the time $\tau_1$-$\tau_2$. Even if the exciting current is interrupted, however, the rotary magnet 104 operates, as described before. Thus, the separator member 106 is prevented from moving from the counterclockwise rotation position to the clockwise rotation position or in the opposite direction. The rotary magnet 104 may be excited by passing therethrough a current equivalent to a fraction, e.g., one fifth, of the exciting current passed through the coils. In this case, the rotary magnet 104 and hence the separator member 106 are kept further stable. Curve (d) of FIG. 6 shows an example of the waveform of the current flowing through the coils 131*a* and 131*b* of the rotary magnet 104 in response to the pulse signals $P_1$ and $P_2$.

The sheet sorting apparatus of this invention can provide various effects owing to the following arrangements. Namely, the substantially triangular separator member 106 used in the sorting mechanism 102 is formed of light material, and the stop positions of the separator member 106 are settled at the positions where the projected portions 126 of the shifting blocks 122 abut against the pulleys 72*c* and 72*n* to guide the first and second main belts 60*a* and 60*b* conveying the sheets 34. In the apparatus of the invention, moreover, the separator member 106 is rotated by the use of the rotary magnet 104 with the rotor 128 formed of a permanent magnet and being relatively simple in construction. With these arrangements, the moment of inertia of the movable parts can be reduced, so that the separator member 106 can quickly rotate according to the torque produced in the rotary magnet 104 to reach both the counterclockwise and clockwise rotation positions. Moreover, the separator member 106 can be so designed as to engage the pulley 72*c* and 72*n* at the projected portion 126 projecting off the rotating shaft 112. Since the separator member 106 is light in weight, only a small impact is produced when the projected portion 126 runs against the pulley 72*c* or 72*n*. Accordingly, wear or other damage to the clashing members, as well as noise and vibration, may be reduced. As shown in FIG. 2, the two lateral faces 126*a* and 126*b* of the triangular separator member 106 are isolated from the rotating shaft 112, so that the sheets 34 delivered from the main superposed section 62 are guided by the lateral face 126*a* or 126*b* toward the first or second auxiliary superposed section 64 or 68. Thus, the sheets 34 will neither be bent in the space 82 nor be prevented from running by the rotating shaft 112. This effect enables partially borken sheets, if any, to be fed smoothly into the first and second auxiliary superposed sections 64 and 68. The path extending between the main superposed section 62 and the first or second auxiliary superposed section 64 or 68 can be shortened by minimizing the distance between the one pair of pulleys 72*c* and 72*n* and the other pair of pulleys 72r and 72u determining the shape of the triangular space 82. Accordingly, even if the sheets 34 lack firmness, there is no fear of the sheets 34 being dog-eared or crumpled or jamming in the path between the main and auxiliary superposed sections. The rotor 128 is formed of a permanent magnet, and can stay in the first or second position even if the exciting current flowing through the rotary magnet 104 is reduced to zero. This effect leads to an economizing of electric power and minimizes the temperature increase of the rotary magnet 104.

Figure 8:
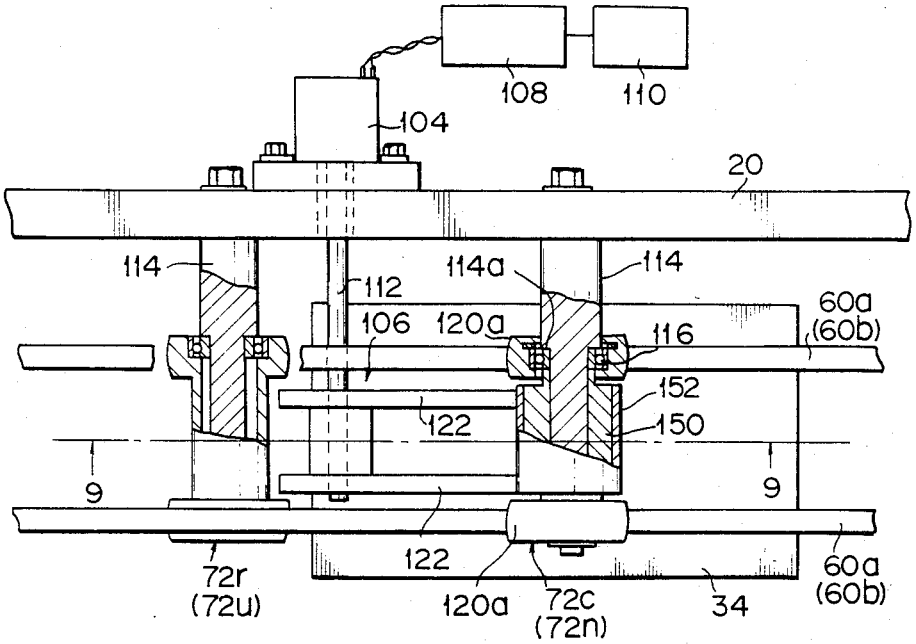
FIG. 8 is a plan view of a modification of the sorting mechanism using separating pulleys different in construction from the ones shown in FIG. 3.

Referring now to FIG. 8, a modification of the aforementioned embodiment will be described. In the embodiment shown in FIGS. 2 and 3, the projected portion 126 of each shifting block 122 engages the neck portion 120b of the pulley 72c or 72n when the rotor 128 is driven. Namely, the projected portion 126 slidingly engages the rotating neck portion 120b. Thus, both the engaging members 122 and 120b are subject to abrasion by sliding action, and the life of the apparatus may be shortened. The modification of FIG. 8 is contrived to eliminate such a drawback, and has basically the same construction as that of the embodiment of FIGS. 2 and 3. In FIG. 8, each of the pulleys 72c and 72n comprises the suppporting shaft 114, the two ball bearings 116, the large-diameter portions 120a fitted individually on the outer peripheries of the ball bearings 116 to guide the two first main belts 60a, and a fixed cylinder 150 fixed to the supporting shaft 114. The fixed cylinder 150 is covered, as required, with a sheath 152 made of elastic material such as rubber. Fixed to the supporting shaft 114, the fixed cylinder 150 and the sheath 152 never rotate. Since the fixed cylinder 150 and the sheath 152 are somewhat longer than the distance between the two shifting blocks 122 of the separator member 106, the projected portions 126 of the shifting blocks 122 engage the stationary sheath 152 when the shifting blocks 122 rotate. Thus, the projected portions 126 and the sheath 152 can engage without sliding. Since the sheath 152 is formed of elastic material, the impact and reaction caused by the engagement are minimized.

Figure 9:
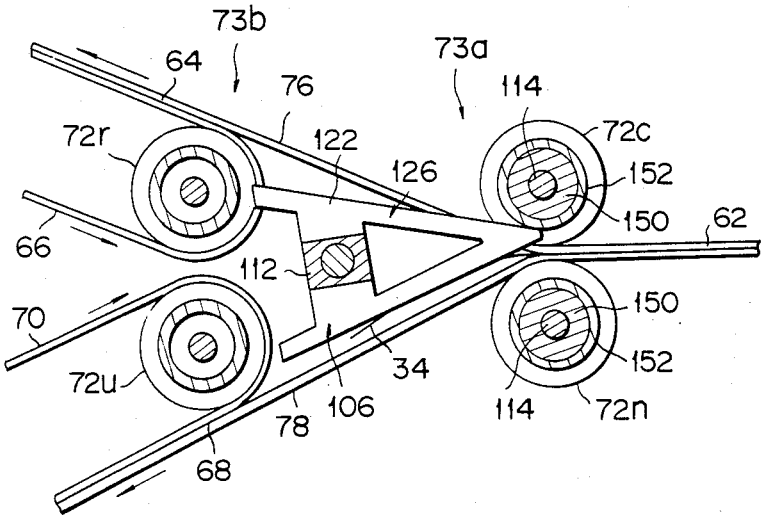
FIG. 9 is a front view of the sorting mechanism of FIG. 8 taken along line 9—9 of FIG. 8.

FIG. 9 is a front view of the principal part of the mechanism shown in FIG. 8 as taken along line 9—9 of FIG. 8. FIG. 9 shows cross sections of the supporting shafts 114, the fixed cylinders 150, and the sheaths 152. In the state shown in FIG. 8, the projected portion 126 of each shifting block 122 engages the sheath 152 of the pulley 72c.

Figure 10:
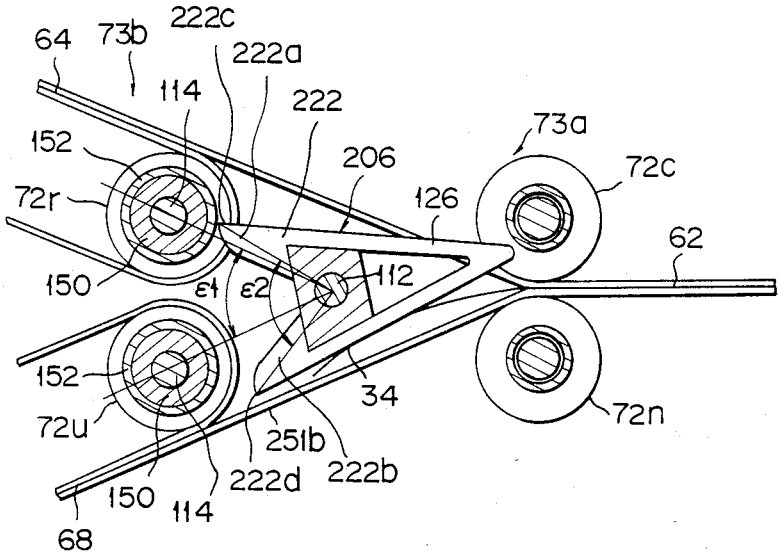
FIG. 10 is a front view of a sorting mechanism according to another embodiment of the invention.

In the foregoing embodiment, the projected portion 126 of the separator member 106 engages the pulley 72c or 72n to settle the position of the separator member 106. In a second embodiment shown in FIG. 10, two projected portions extending opposite to the projected portion 126 of a separator member 206 engage the pulley 72r or 72u to settle the angular position of the separator member 206. This embodiment differs from the embodiment of FIG. 2 only in the shape of the separator member and the construction of the pulleys 72r and 72u. Therefore, the apparatus according to this embodiment is shown only partially in FIG. 10. The separator member 206 of FIG. 10 is provided with projected portions 222a and 222b projecting from a shifting block 222 toward the pulleys 72r and 72u. The pulleys 72r and 72u are mounted on the supporting shafts 114 in the same manner as the pulleys 72c and 72n shown in FIGS. 8 and 9. The fixed cylinder 150 and the sheath 152 identical with those shown in FIG. 9 surround the supporting shaft 114 of each of the pulleys 72r and 72u of FIG. 10. An angle $\epsilon_2$ formed between straight lines connecting extreme ends 222c and 222d of the projected portions 222a and 222b and the center of the rotating shaft 112 is greater than an angle $\epsilon_1$ formed between straight lines connecting the respective centers of the pulleys 72r and 72u and the center of the rotating shaft 112. When the separator member 206 driven by the rotary magnet 104 rotates counterclockwise to reach the position where it can smoothly guide the sheets 34 delivered from the main superposed section 62 toward the second auxiliary superposed section 68, the extreme end 222c rotates counterclockwise around the rotating shaft 112 to engage the sheath 152 of the fixed cylinder 150 of the pulley 72r, thereby stopping the rotation of the separator member 206. When the separator member 206 driven by the rotary magnet 104 rotates clockwise to reach the position where it can smoothly guide the sheets 34 to the first auxiliary superposed section 64, the extreme end 222d of the projected portion 222b rotates clockwise to engage the sheath 152 of the pulley 72u, thereby stopping the rotation of the separator member 206. The triangular projected portion 126 of this embodiment projecting on the right of the rotating shaft 112 is shorter than that of the embodiment of FIG. 2, so that it will engage neither of the pulleys 72c and 72n even though the separator member 206 rotates to engage the sheath 152 of the pulley 72r or 72u. In this case, the projected portion 126 is not used for determining the angular position of the separator member 206, and is used only to guide the sheets 34 to the specified auxiliary superposed section by means of its lateral face 126a or 126b.

Figure 11:
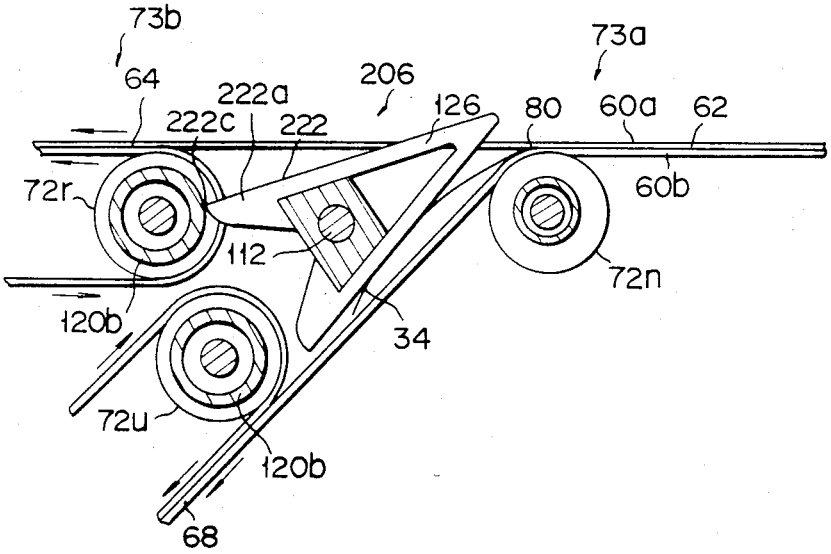
FIG. 11 is a front view of a sorting mechanism according to still another embodiment of the invention showing one operating state thereof.
Figure 12:
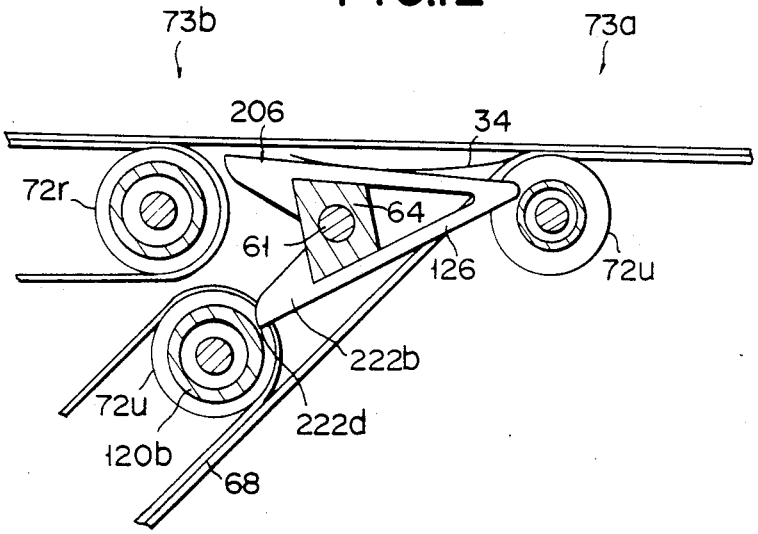
FIG. 12 is a front view of the sorting mechanism of FIG. 11 showing another operating state different from the state shown in FIG. 11.

According to the system of the aforementioned second embodiment, it is unnecessary to settle the angular position of the separator member 106 by the pulleys 72c and 72n. It is therefore possible to omit, for example, the pulley 72c so that the first main belt 60a passing through the main superposed section is run straight without changing its course, and that only the second main belt 60b is shifted in its course by means of the pulley 72n to form the triangular space. FIGS. 11 and 12 show the arrangements of the pulleys and the main courses of the belts according to a third embodiment constructed in this manner. In FIGS. 11 and 12, the pulleys 72r and 72u of FIG. 2 showing the first embodiment are lowered in position so that the first main belt 60a forming the main superposed section 62 may run without changing its course, and the pulley 72c of FIG. 2 is omitted. In the state shown in FIG. 11, the separator member 206 is rotated counterclockwise so that the extreme end 222c of the shifting block 222 engages the neck portion 120b of the pulley 72r to be stopped thereby. In the state shown in FIG. 12, the separator member 206 is rotated clockwise so that the extreme end 222d of the projected portion 222b engages the neck portion 120b of the pulley 72u to be stopped thereby.

Although illustrative embodiments as typical examples of the sheet sorting apparatus of this invention have been described in detail herein, it is to be understood that the invention is not limited to those embodiments, and that various changes and modifications may be effected therein by one skilled in the art without departing from the scope or spirit of the invention. In the above embodiments, the separator member 106 or 206 comprises the two substantially triangular shifting blocks 122. Alternatively, three or more shifting blocks 122 may be used depending on the width of the sheets 34 handled. Also, the shifting blocks 122 may be located outside the first and second main belts 60*a* and 60*b* so as to guide those portions of the sheets 34 which protrude from the main belts. More specifically, the traingular shifting blocks 122 may be V-shaped or A-shaped. The A-shaped shifting blocks 122, which have a triangular opening each for lighter weight, are shown in FIGS. 1, 2, 4, 7, 9, 10, 11 and 12.

In the above embodiments, moreover, the parallel pairs of belts and the pulleys to guide the same are arranged to carry the sheets 34 while holding them on both sides. Alternatively, the belts may be arranged in a row or in three or more rows.

In FIG. 1, the sheets 34 are distributed into two collectors by means of the single sorting mechanism 102. Alternatively, however, two or three sorting mechanisms may be arranged in the path of the sheets 34 so as to classify the sheets 34 into a multitude of groups.

What is claimed is:

1. A sheet sorting apparatus comprising:

a delivery device for delivering sheets one after another;

first and second main belts separated at an angle from each other after running through a main superposed section in which said belts hold and carry the delivered sheets, and defining a triangular space therebetween adjoining said main superposed section;

first and second auxiliary belts superposed on part of said main belts to form first and second auxiliary superposed sections, respectively;

pulley means for guiding all said belts, said pulley means including a plurality of space-shape determining pulleys to determine the shape of said space;

a separator member rockably supported in said space and rocking between first and second positions through a predetermined sorting angle to guide the sheets fed from said main superposed section into said space to one of said auxiliary superposed sections corresponding to the rocking direction of said separator member, said separator member being rocked through said predetermined sorting angle when at least one projected portion of said separator member engages said space-shape determining pulleys;

means for rocking said separator member, said means for rocking comprising a rotary actuator including:

(a) a rotary shaft upon which said separator member is mounted, (b) a rotary member mounted on said rotary shaft for rotation with said separator member, whereby said rotary member can rotate through said predetermined sorting angle, (c) a drive section positioned for acting upon said rotary member said drive section and said rotary member including means for positively retaining said separator member in each of said first and second positions without contact between said rotary member and said drive section, said drive section including means for inducing selective rotation of said rotary member through a rotation angle in two opposite directional senses without contact between said rotary member and said drive section, said rotating angle being greater than said predetermined sorting angle, whereby rotation of said separator member is limited at two positions defined by said separator member engaging said space shape determining pulleys, and whereby said drive section continues to induce selective rotation of said rotary member at each of said two positions; and first and second collectors receiving and holding therein the sheets delivered from said first and second auxiliary superposed sections.

2. The apparatus according to claim 1, wherein said space-shape determining pulleys include two separating pulleys arranged at the terminal end of said main superposed section to determine the position of a diverging point at which said first and second main belts spread at an angle to each other, and two guide pulleys to determine the respective course of said first and second main belts spreading at said diverging point.

3. The apparatus according to claim 2, wherein said separator member has a triangular projected portion projecting between said separating pulleys so that, when said separator member is rocked, said triangular projected portion engages one of said separating pulleys located in the rocking direction to stop the rocking of said separator member.

4. The apparatus according to claim 3, wherein each said separating pulley has a large-diameter portion rotating as each corresponding main belt thereon runs, and a neck portion coaxially protruding from said large-diameter portion, said neck portion engaging said projected portion when said separator member is rocked.

5. The apparatus according to claim 3, wherein each said separating pulley has a large-diameter portion rotating as each corresponding main belt thereon runs, and a fixed cylinder fixed to a supporting shaft supporting said large-diameter portion, said fixed cylinder engaging said projected portion when said separator member is rocked.

6. The apparatus according to claim 5, wherein said fixed cylinder is provided with a sheath made of elastic material.

7. The apparatus according to claim 2, wherein said separator member has two projected protions projecting toward said guide pulleys, said projected portions engaging their corresponding guide pulleys to stop said separator member from rocking when said separator member is rocked.

8. The apparatus according to claim 7, wherein each said guide pulley has a large-diameter portion rotating as each corresponding main belt thereon runs, and a neck portion coaxially protruding from said large-diameter portion, said neck portion engaging each corresponding projected portion when said separator member is rocked.

9. The apparatus according to claim 7, wherein each said guide pulley has a large-diameter portion rotating as each corresponding main belt thereon runs, and a fixed cylinder fixed to a supporting shaft supporting said large-diameter portion, said fixed cylinder engaging each corresponding projected portion when said separator member is rocked.

10. The apparatus according to claim 9, wherein said fixed cylinder is provided with a sheath made of elastic material.

11. The apparatus according to claim 1, wherein said space-shaped determining pulleys include a separating pulley disposed at the terminal end of said main superposed section to determine the position of a diverging point at which said first and second main belts spread at an angle to each other, and two guide pulleys to determine the respective course of said first and second main belts spreading at said diverging point, and that said separator member has two projected portions projecting toward said guide pulleys and engaging their corresponding guide pulleys when said separator member is rocked, thereby restricting the rocking of said separator member within a fixed range.

12. The apparatus according to claim 1, wherein said rotary member is a rotary magnet connected directly to said separator member.

13. The apparatus of claim 12 wherein said rotary magnet comprises a permanent magnet and wherein said drive section comprises:

a stator formed of soft magnetic material and coaxially surrounding said permanent magnet;

at least one pair of poles projecting from said stator and towards said permanent magnet, poles of each said at least one pair being formed opposite one another with said rotary shaft therebetween;

an exciting coil wound around said stator;

means for selectively inducing an electric current through said exciting coil; and means for selectively reversing the polarity of said electric current, whereby said polarity reversal induces movement of said separator member between said two positions and whereby said permanent magnet retains said separator member at each of said two positions.

* * * * *